United States Patent [19]

Cummings

[11] 4,368,551

[45] Jan. 18, 1983

[54] COMMODE ENCLOSURE FOR FORMING A UTILITY CABINET

[76] Inventor: Kent Cummings, 17487 Common Rd., Roseville, Mich. 48066

[21] Appl. No.: 167,824

[22] Filed: Jul. 14, 1980

[51] Int. Cl.[3] ..... A47K 13/00

[52] U.S. Cl. ..... 4/661; 4/242; 4/253; D23/71

[58] Field of Search ..... 4/300, 476, 479, 480, 4/661, 418, 422, 485, 585, 242; 297/194, 378; D23/2, 48, 49, 53, 65–68, 69–71

[56] References Cited

U.S. PATENT DOCUMENTS

| | | | |
|---|---|---|---|
| B 517,956 | 4/1976 | Halvorsen | D23/53 X |
| 906,077 | 12/1908 | Spencer | 4/253 |
| 1,180,140 | 4/1916 | Godoy | 4/485 |
| 1,793,815 | 2/1931 | McCann | 4/253 |
| 1,841,143 | 1/1932 | McCann | 4/580 |
| 2,994,887 | 8/1961 | Thornton | 4/242 |
| 3,149,346 | 9/1964 | Springer | 4/476 X |
| 3,566,414 | 3/1971 | Basner | 4/661 |
| 3,905,051 | 9/1975 | Gozdziewski | 297/378 X |

*Primary Examiner*—William D. Martin, Jr.
*Attorney, Agent, or Firm*—Remy J. VanOphem

[57] ABSTRACT

A decorative enclosure for conventional toilets to form a utility cabinet is disclosed. The enclosure provides an adjustable structure which fits over and conceals the conventional toilet and tank. The structure has a bottom closure cabinet with a hinged seating portion which fits over the toilet aperture and a top closure member which fits over the toilet tank. An adjustable toe kick member is provided to permit adjustment of the seat assembly portion of the enclosure to the proper height for use with an existing toilet bowl. A centering member is provided to locate the cabinet relative to the aperture in the toilet, to conform to the contour of the aperture and to provide a mount for the toilet seat. After adjustment of the toe kick member, the enclosure may be permanently fixed in place. A flusher assembly access hole is formed in the lid of the tank cover to connect a handle mounted on the lid to the flusher assembly of the conventional toilet. Optionally, the flusher assembly may be operatively engaged by lifting the lid of the tank cover. The enclosure further conceals the conventional toilet by providing a seat cover over the toilet seat which permits the enclosure to be used for seating purposes or as a utility end table.

7 Claims, 3 Drawing Figures

COMMODE ENCLOSURE FOR FORMING A UTILITY CABINET

BACKGROUND OF THE INVENTION

1. Field of the Invention

The present invention relates to enclosures and particularly to decorative enclosures for conventional toilets in a bathroom.

2. Description of the Prior Art

The practical, ordinary, drab, mechanical toilet has heretofore had a more or less standard appearance in the household bathroom. Although great care is taken to otherwise beautify the bathroom with rugs, curtains, decorative fixtures, special lighting, and other beautifying techniques, very little has been done to overcome the utilitarian, ordinary toilet. Attempts have been made to disguise or otherwise beautify the toilet such as by providing toilet tank covers and seat covers of pastel materials. Fancy and padded seats have also been proposed and used on many toilets and specially designed rugs are often laid underneath the toilet to obscure somewhat the drab, ordinary look of the toilet. Nonetheless, these efforts do not eliminate the mechanical, non-furniture look of the standard tank and supported bowl toilet structure.

Thornton, U.S. Pat. No. 2,994,887 describes a typical toilet seat and lid covering provided to beautify a toilet seat and make it more comfortable and exemplifies past attempts to make a bathroom and its furnishings more aesthetically pleasing and a more integral part of the remainder of the home furnishings.

Many devices have been proposed in the past to temporarily close a toilet seat or bathtub in order to protect it during installation or storage. Examples of such temporary closure devices are Spencer, U.S. Pat. No. 906,077; McCann, U.S. Pat. No. 1,793,815; and McCann, U.S. Pat. No. 1,841,143.

Godoy, U.S. Pat. No. 1,180,140 provides a sink cover usable with vaults, sinks, water closets, and the like wherein a seat is connected to an aerosol can or freshener or an automatic air dispenser which periodically discharges freshening scent into the room. A toilet tissue dispenser can also be built into the commode enclosure and may be hidden from view in a compartment under a flap or by some other provision in the cabinet of the commode enclosure. Many variations of these options to the commode enclosure are possible, just as many possible variations are known for toilet tissue dispensers on the wall, or on the sides of the cabinets.

SUMMARY OF THE INVENTION

The furniture cabinet or commode enclosure is constructed to completely conform the conventional toilet and tank combination into a utility cabinet, be it for purposes of a seating area or perhaps to use as a utility end table. The enclosure may be formed by injection molding to provide a one piece structure easily fitted over the conventional toilet and tank. Whether the furniture cabinet is injection molded in one piece construction, made from more than one piece and later assembled, or otherwise constructed, as exemplified by the preferred embodiment of the present invention. An adjustable toe kick member is required to adjust the seat assembly portion of the commode enclosure to the proper height for use with an existing toilet bowl. Alternatively, shims may be provided. Once the height of the cabinet has been appropriately adjusted, the position of the furniture cabinet may be permanently fixed in place by fastening the cabinet to the wall at the rear of the unit by any convenient means. The cabinet unit may also be self centering and locating with respect to an existing toilet bowl. Thereafter, the flusher assembly access hole must be properly formed or punched out so as to expose access to the flusher assembly of the toilet being covered. The flusher assembly handle may consist of the standard toilet handle, push button, or other flusher assembly device. Also, means are provided, if preferred, to flush the toilet by lifting the lid of the tank cover. Optionally, the flusher assembly handle of a conventional home toilet may be replaced with a decorative handle or other device which disguises the flusher assembly to give it the appearance of part of a piece of furniture.

Therefore, it is an object of the present invention to provide a commode enclosure which functions both to conceal an otherwise drab, ordinary, mechanical toilet while simultaneously providing a utilitarian and beautifying piece of furniture in the bathroom.

It is also an object of the present invention to provide a commode enclosure which muffles somewhat the sound of the flushing action of a conventional toilet. It is also an object of the present invention to provide a commode enclosure which encompasses such optional features as fragrance dispenser, toilet tissue dispenser, lighting means, condensation drip tray, and other accessories.

These and other objects of the present invention will be apparent from the following description of the preferred embodiment and with reference to the drawings provided herewith.

DETAILED DESCRIPTION OF THE PREFERRED EMBODIMENT

Figure 1:
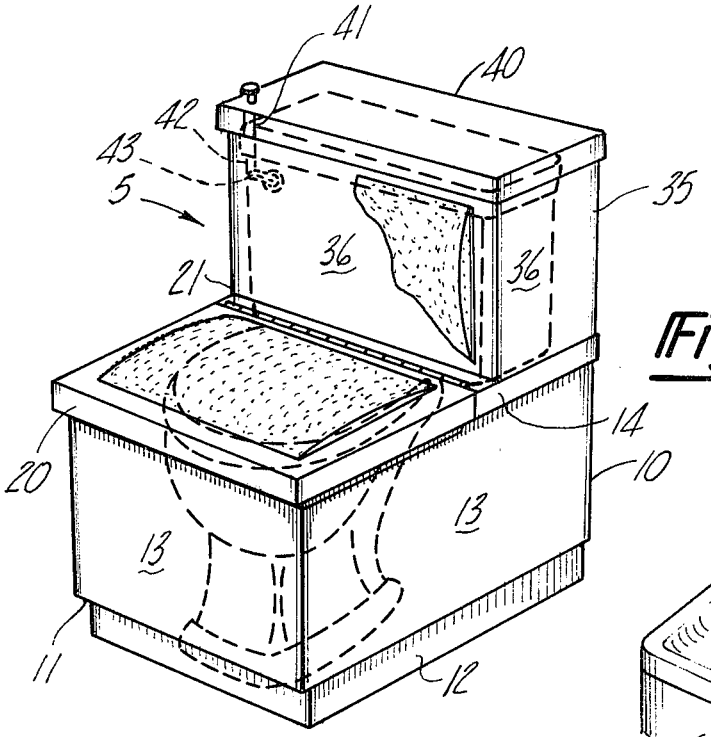
FIG. 1 is a perspective view of the contemporary commode according to the invention.
Figure 3:
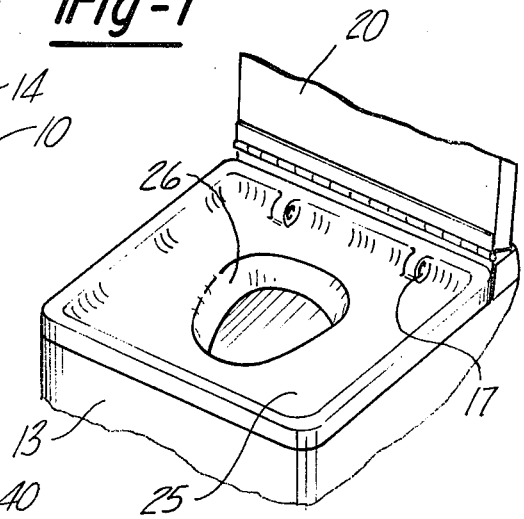
FIG. 3 is a partial perspective view showing the centering member in position on the contemporary commode.
Figure 2:
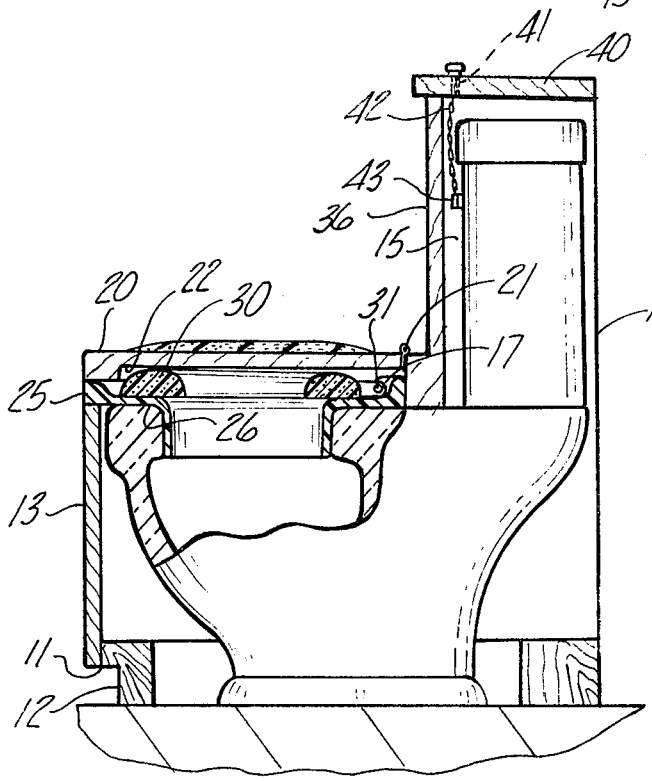
FIG. 2 is a partial sectional view of the contemporary commode shown in FIG. 1.

FIGS. 1 through 3 show the preferred embodiment which consists of a toilet bowl and tank enclosure 5 having a bottom closure cabinet 10 with a hinged seating portion 20 at the front thereof and a top closure cabinet 35 mounted to the rear portion of the bottom closure cabinet 10. If a one piece construction is chosen, the top and bottom closure cabinet would be molded as a single unit. The base of the bottom closure cabinet 10 may be rectangular or alternately contoured to conform to an aesthetically desired form. A recess base portion 11 is provided with a kick plate 12 so that the bottom closure cabinet can be protected from shoe marks from a person using the toilet. The bottom closure cabinet has upright members 13 on three sides of the toilet to which is connected a horizontal top panel cover or tray member 14. The top panel cover member 14 has an opening 15 at the rear 16 thereof for permitting the attachment of the top closure cabinet 35. At the front of the top panel cover member 14 is a hinged seating portion or seat cover member 20 which cooperates with a hinge 21. The seating portion 20 is hinged to the tray or top panel cover member 14 so as to permit the hinged seating portion 20 to be swung out of place when the toilet is to be used. A centering member 25 is placed into the contour 26 of the aperture of the toilet. The centering member 25 is attached to the upright members 13 of the bottom closure cabinet 10. The centering member 25 is of unitary construction so as to fit on top of the aperture of the toilet and so as to conform to the contour 26 of the aperture of the toilet. The centering member 25 also locates the bottom closure cabinet 10 relative to the aperture in the toilet. The toilet seat 30 is also attachable to the centering member 25 by a hinge 31 at the rear thereof so that the toilet seat 30 may be moved out of its horizontal position to utilize the conventional toilet as a urinal or to clean the toilet when necessary. Appropriate upright attachment lugs 17 are provided in the centering member 25 to cooperate with the hinge 31 on the toilet seat 30. The centering member 25 may be made of any conventional material but preferably of a material which is nonporous to avoid the obvious health problems that could develop with a porous material. The centering member 25 is made with various sized contours 26 of the aperture of the toilet in order to accommodate various apertures available in conventional toilets.

The underside of the hinged seating portion 20 is undercut 22 such that when the hinged seating portion 20 is placed in a horizontal position, the undercut surface 22 mates with the top panel cover member 14 on three sides to provide structural rigidity for seating purposes or in the alternative, to support decorative items such as perhaps a table lamp if the unit is desired to be used as an end table.

The hinged seating portion 20 can also be constructed in such a manner as to provide a hinged cover sufficiently wide to allow comfortable access to the toilet while at the same time providing two narrow fixed strips on both sides of the toilet seat to which may be attached appropriate uprights for the purpose of permitting users of the toilet to rest their arms. The arm rests may be constructed to a desired length according to the convenience of the user, and may be attached to the hinged seating cover as well as the uprights of the top closure as necessary.

At the rear of the bottom closure cabinet 10, an opening 15 is provided wherein is mounted a top closure cabinet 35 to surround the conventional tank which is attached to the conventional toilet bowl. The top closure cabinet 35 has three upright members 36 attached to the bottom closure cabinet 10 sufficiently high to extend beyond the outlines of the tank so that a top cover 40 may be placed on the uprights in order to completely surround the conventional water tank. The top cover 40 may be permanently fixed to the upright members 36 or preferrably the top cover 40 is removable so as to provide access to the water tank in case of plumbing problems.

In the top cover 40 of the top closure cabinet 35 of the tank, an aperture 41 maybe provided so that any convenient pull cord 42 may be used in order to enable flushing of the tank. Any other access means may be used to permit flushing of the toilet. The pull cord 42 is arranged so as to communicate with the present flush actuating mechanism 43 in order to allow the user to flush the toilet. If necessary, the aperture 41 for the pull cord 42 to actuate the present flushing actuator of the toilet may be located in any convenient spot wherein access is obtainable to the present flush actuating mechanism 43 of the toilet tank combination. An alternate arrangement may be provided wherein lifting of the top cover 40 itself actuates the flushing of the toilet. Therefore, instead of the aperture in the cover, the pull cord 42 may be directly attached to the top cover 40 and the lifting of the cover thereby provides the necessary motion to flush the toilet.

It is readily apparent to one skilled in the art that the complete enclosure may be made of a plastic material and molded as a one-piece base. To this base would be attached an appropriate adjustment member between the lower uprights of the bottom closure cabinet in order to permit adjustment in the location of the closure with respect to the aperture of the toilet bowl. Also, the cover associated with the seat of the toilet may also be conveniently molded and attachable to the injection molded enclosure to be utilized as taught in this invention. Depending upon the preference of the individual, both the hinged seating portion 20 as well as the front side of the top closure cabinet uprights 36 may be padded if the commode enclosure is utilized for seating purposes. Instead of the padding, flat hard decorated surfaces may be provided and again depending upon the user's preference, the enclosure may be utilized as an end table whereupon a lamp can be placed in order to provide an aesthetically pleasable toilet bowl and tank enclosure cabinet.

It is readily apparent to one skilled in the art that the upright members of both the bottom and top closure cabinets may be made to conform to the outline of the toilet or be made to provide contoured areas to conform to the rest of the decor utilized in the bathroom or the furniture decor utilized throughout the home. Also, it is readily apparent that the top closure cabinet may provide extensions which straddle the seat area so that the user may be permitted to rest his arms upon these extensions while utilizing the toilet. This can also be accomplished by limiting the top hinge cover to that portion of the area just covering the toilet bowl as set forth above. The cover to either side of the toilet bowl could be permanently fixed to the upright members so that an armrest of some type is attachable to this fixed area and provides armrests for the user. The armrests would be mounted to either side of the cover or to the side members 13 and permanently fixed to either the cover or side members.

Having described the invention, what is claimed is:

1. A contemporary commode enclosure used to enclose the conventional toilet bowl and flush tank, said contemporary commode comprising:

a lower closure means having at least one upright member enclosing said toilet bowl, said at least one upright member further extending substantially to the same height as said toilet bowl;

a top panel cover member attached to said at least one upright member, said top panel member having an aperture therein, said aperture located proximate said toilet bowl outline, said top panel member further having an end portion having an opening;

an upper closure means having at least one upright member enclosing said tank, said upper closure means mounted to said lower closure and within said opening of said end portion of the top panel member and further extending substantially to the same height as said flush tank;

a cover member mounted to said at least one upright member of said upper closure means such that said cover member and said at least one upright member cooperate to completely enclose said flush tank;

hinge means mounted to said top panel cover member proximate said at least one upright member of said upper closure means;

a seat cover member mounted adjacent to said top panel cover member and attached to said hinge means so that said seat cover member cooperates with said top panel cover member to cover said aperture of said top panel member when said seat cover member is in one position and whereby said seat cover member rotates upwards to rest against said at least one upright member of said upper closure means to uncover said aperture of said top panel cover member when said seat cover member is in a second open position;

an adjustable centering member mounted to said at least one upright member of said lower closure means and said top panel member, said adjustable member having an extended portion adapted to engage the bowl aperture of the toilet bowl;

means for flushing said flush tank, said flushing means including means for attaching said flushing means to said cover member;

means for adjusting said lower closure means whereby said enclosure may be adjusted to a predetermined height according to the height of a toilet to be enclosed; and resilient means attached to said upper closure means and said seat cover member such that when the enclosure is used as a chair, the resilient means provides a cushioned seat for seating and cushioned upper closure means as a seat back rest for the user.

2. The contemporary commode enclosure as claimed in claim 1 wherein said means for flushing includes means for mounting said flushing means to said at least one upright member of said upper closure means.

3. A commode enclosure as defined in claim 2 wherein said flushing means operates by push button means.

4. The contemporary commode enclosure as claimed in claim 1 further comprising armrest means attached to said upper closure means to provide rests for the users arms when seated on the contemporary commode.

5. The contemporary commode enclosure as claimed in claim 1 wherein said means for flushing is concealed within said upper closure means and cover member.

6. The contemporary commode enclosure as claimed in claim 1 wherein said upper closure means, lower closure means, top panel cover member are injection molded as a singular unit.

7. The contemporary commode enclosure as claimed in claim 1 wherein said adjustable member is water repellent.

* * * * *